United States Patent [19]

Munoz, Jr.

[11] Patent Number: 4,785,593

[45] Date of Patent: Nov. 22, 1988

[54] STRUCTURAL BUILDING SYSTEM

[76] Inventor: Jose C. Munoz, Jr., 1510 E. Colter #114, Phoenix, Ariz. 85014

[21] Appl. No.: 923,173

[22] Filed: Oct. 27, 1986

[51] Int. Cl.[4] ..... E02D 27/00

[52] U.S. Cl. ..... 52/126.1; 52/296; 52/298; 52/741

[58] Field of Search ..... 52/292, 298, 296, 297, 52/126

[56] References Cited

U.S. PATENT DOCUMENTS

| | | | |
|---|---|---|---|
| 1,650,093 | 11/1927 | Rank | 52/298 |
| 2,095,832 | 10/1937 | Retzke | 52/296 |
| 2,103,410 | 12/1937 | Frei, Jr. | 52/296 |
| 3,135,364 | 6/1964 | Lattrell | 52/296 |
| 3,353,852 | 11/1967 | Wood | 52/296 |
| 3,713,262 | 1/1973 | Jacko | 52/296 |

FOREIGN PATENT DOCUMENTS

| | | | |
|---|---|---|---|
| 705400 | 6/1931 | France | 52/297 |
| 784080 | 7/1935 | France | 52/297 |
| 1401315 | 4/1965 | France | 52/296 |
| 1406299 | 6/1965 | France | 52/297 |
| 405325 | 8/1943 | Italy | 52/298 |

*Primary Examiner*—Henry E. Raduazo

*Attorney, Agent, or Firm*—Gregory J. Nelson

[57] ABSTRACT

A structural column member and method of erecting same in which the column includes a base and upwardly extending column support. A connector or coupling having a tapered alignment position is received in both the lower end of the tubular column and the upper end of the tubular support. The components are then adjusted to the correct position and secured as a rigid unit by welding. The system is particularly applicable to tilt-up building construction as the column support can be positioned at the time the floor slab is poured.

1 Claim, 2 Drawing Sheets

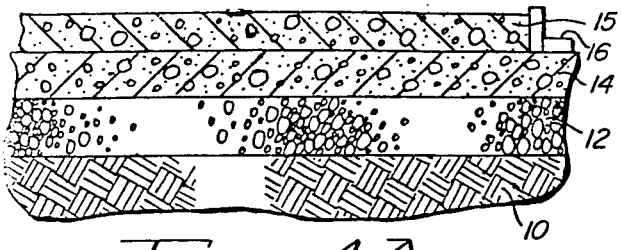
FIG. 1A
(PRIOR ART)
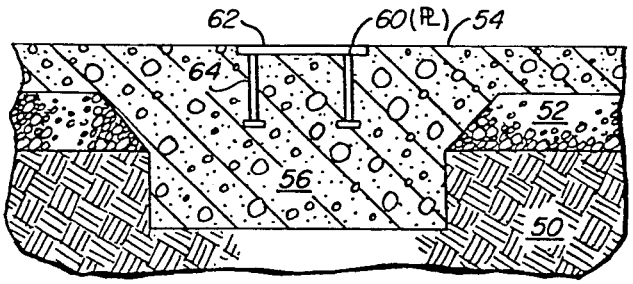
FIG. 2A
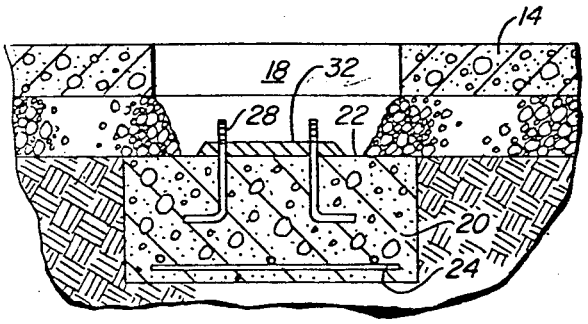
FIG. 1B
(PRIOR ART)
FIG. 2B
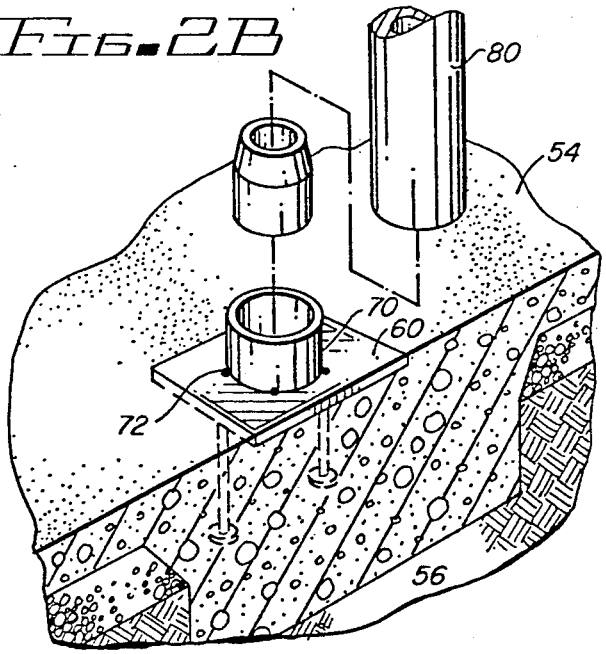
FIG. 2C
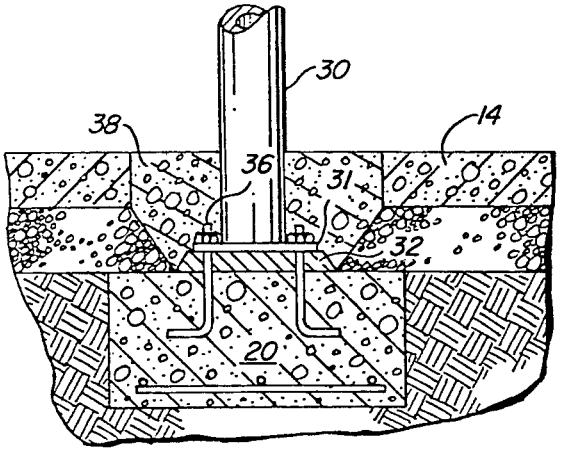
FIG. 1C
(PRIOR ART)
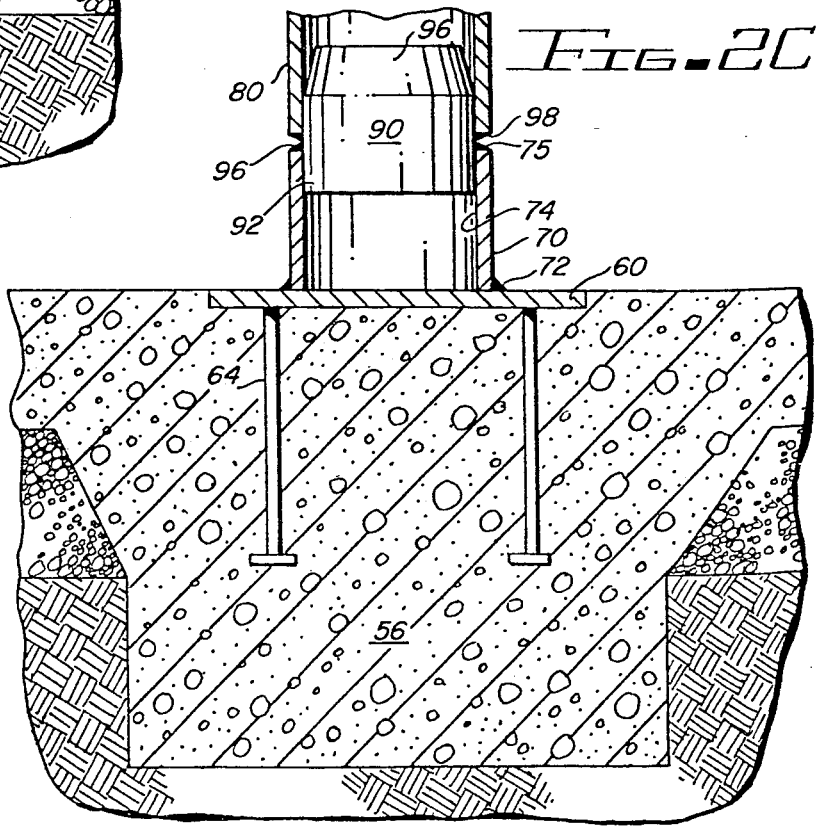
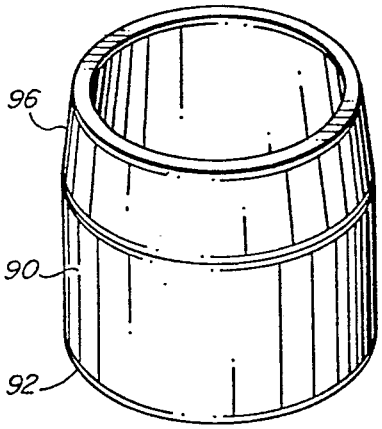
FIG. 3

STRUCTURAL BUILDING SYSTEM

This application is a refiling of application Ser. No. 06/428,939, filed Sept. 30, 1982, now abandoned.

The present invention is directed by a building construction system and more particularly to a system for erecting vertical column members as part of the structural framework of a building.

Building column systems utilizing steel construction are fabricated in various ways. For example, it has been practice in conventional steel construction to fabricate the columns with a base plate secured to the column by welding, bolts or rivets. The columns seat centrally on the base plate. The base plates are secured to the concrete foundation by suitably placed anchor bolts.

In other types of construction, particularly as utilized for commercial buildings, the practice is to utilize performed concrete walls. Generally after the footing is firm, the floor is poured and when the floor slabs have set-up, the floor is coated with an appropriate release agent. The floor itself is used as part of the form for molding the building walls as the walls are formed on the floor surface. This type of system is sometimes referred to as a "tilt-up" system.

When the walls have been poured and have set-up, the forms are removed and the walls tipped into place in a vertical position. Thereafter, it is generally necessary for the contractor to come back and cut the floor slab at locations where vertical support columns are to be placed. This is usually accomplished by use of a diamond saw. Thereafter, it is necessary to dig out a footing at the location. The footing must then be poured and the base of the column anchored in place by suitable anchor bolts. The base of the column is normally below the elevation of the floor so it is necessary to fill the cut area around the column with concrete and smooth the concrete and allow the concrete to dry.

Obviously, with the construction system described above, there are a number of steps involved which are both expensive and time consuming. Diamond cutting through concrete is a rigorous time consuming job. Further, it is generally necessary that the footing first be poured and allowed to set. Thereafter, the floor is cut and broken away and the columns are placed and a second cementing operation is necessary to finish the area around the columns.

The present invention provides an improved building system applicable to buildings using preformed walls and vertical columns. The present invention obviates the disadvantages cited above attendant to prior art construction methods. With the present method, the column footing and floor slab are poured in a single operation. Saw cutting or breaking through the concrete to position the column is not necessary. The system of the present invention leads itself to placement of columns either at a base elevation below the slab or at the surface elevation of the slab.

Briefly, the present invention utilizes a bearing plate which is embedded in the floor slab of the structure when it is poured. The bearing plate is positioned with its upper surface planar with the surface of the floor slab. Thereafter, the floor slab can be used as a portion of the mold for casting the tilt-up side walls of the structure. When the side walls are formed and tilted in place, a column base is welded to the bearing plate. A connector or coupler which permits relative adjustment of the column relative to the column base or stub is tack welded to the column stub. The vertical column, which is generally cylindrical, is placed over the end of the connector and the column is vertically oriented to the proper position. When this is accomplished, the entire peripheral area between the pipe column and stub is continuously filled with a weldment. In an alternate embodiment, the upper end of the column base or stub is positioned at or slightly below the elevation of the floor slab and the attachment to the column using the connector is made at this point.

Accordingly, it is an object of the present invention to provide an improved building column system which is substantially less costly, requires less labor and less time than prior systems. Another significant advantage of the present invention allows the column to be easily and precisely oriented in a vertical position. The above and other objects and advantages of the present invention will become more apparent from the following description, claims and drawings in which:

FIGS. 1A and 1B illustrate prior art column building systems;

FIGS. 2A to 2C illustrate the sequence of steps involved in constructing the column system of the present invention;

FIG. 3 is a perspective view of the connector sleeve;

Figure 4A:
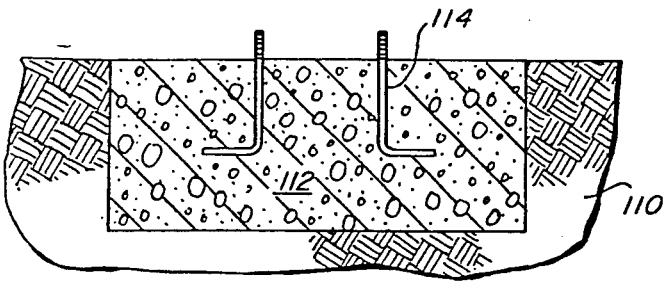
FIGS. 4A to 4E illustrate the sequential steps involved in erecting the column system of the present invention in an alternate manner with the base plate below the elevation of the surface of the floor slab.

An understanding of the present invention will be had from the drawings. In order to better appreciate the present invention, reference is first made to FIGS. 1A to 1C, which illustrate prior art construction systems. Conventional practice has been to first prepare the area 10 by grading and packing and putting down a layer of suitable sub-base material such as ABC 12. Once this has been done, forms are placed and the concrete floor or slab 14 is poured and finished. Once the floor 14 is set-up, the floor itself can then be used as a pat of a mold for other tilt-up components such as vertical side walls. This is accomplished by placing temporary forms 16 on the surface of the floor 14. Thereafter, concrete is poured and the wall members 15 are formed and thereafter positioned in place.

Thereafter, in order to place the vertical structural members or columns at desired locations, the contractor must come back and cut or break through the floor 14 at the column locations as seen in FIG. 1B. This is generally done by diamond cutting an area 18 in the floor 14. The area is excavated and a footing 20 is placed in position generally having its upper surface 22 built below the floor slab 14. Suitable reinforcing 24 may be included in the footing. Grout pad 32 is normally placed on the top of the footing. Anchor bolts 28 are also put in place in footing 20 extending upwardly to accomodate column placement.

The final steps, as seen in FIG. 1C, involve the placement of the column 30 having a base plate 32 resting on the footing pad 31. The column is secured in place by nuts 36 and when this is accomplished, the area surrounding the column is filled with concrete 38 and finished and allowed to dry.

As is apparent, prior art practices involves multiple steps and three or four separate concrete pouring operations. After each pouring, a suitable time must be allowed for the concrete to set. Therefore, the erection of columns in the prior art manner takes considerable time. Further, considerable labor is involved since the floor or slab must be broken or cut-away to provide the location for the columns.

The present invention provides a substantial improvement over column erection systems. It is estimated that with the present invention, construction costs can be reduced at least sixty percent. In view of substantial building costs involved today, such a savings is appreciable and when taken with the reduced time involved in carrying out the method, can mean a great deal to the contractor and owner.

Looking at FIGS. 2A to 2C and FIG. 3, the system of the present invention involves first preparing the area 50 by suitable grading and compacting. Thereafter, a sub-base of ABC or other suitable material 52 is put in place. Forms are positioned for the floor or slab 54 and in the areas or locations where columns are to be placed, the area is excavated to accomodate a footing 56. Once the concrete has been poured and the footing 56 and floor 54 are in place but not firm, a bearing or base plate 60 is positioned above the footing. Bearing plate 60 may be any convenient shape but is preferably shown as being rectangular. The upper surface 62 of the bearing plate is aligned with the plane of the upper surface of floor 54. Suitable anchor bolts 64 are welded or otherwise secured to and depend from the underside of base plate 60 and are securely embedded in the concrete. As seen in FIG. 2A, floor 54 is then allowed to set and once set, the floor can be used as part of the mold arrangement for tilt-up walls as has been described. Since the bearing plate 60 is aligned with the surface of floor 12 and does not project above it, no interference with the fabrication of the tilt-up walls will occur.

When the tilt-up walls have set up and have been put in place and the temporary form removed, the vertical columns can be erected in place. Referring to FIGS. 2B and 2C, this is done by first positioning a column base 70 on bearing plate 60. Base member 70 is centered on plate 60 and tack welded. Thereafter, a continuous bead 72 of fillet welding is placed about the periphery of the base at plate 60.

Base 70 is shown as being a generally cylindrical stub column having an inner diameter 74. The column base projects above the elevation of base plate 60 a suitable distance, typically, in the case of a six inch diameter steel column, a distance of approximately four to six inches.

The column member 80 is also shown as a generally cylindrical steel pipe or tube corresponding in diameter to base member 70. In order to join the column 80 to the base 70, a coupling or connector 90 as best seen in FIG. 3 is utilized. The connector 90 is shown as a generally cylindrical member having an outer diameter closely approximating the inner diameter 74 of base 70. The upper edge of the connector 90 is provided with an alignment section 96. The alignment section consists of an upwardly converging taper so that the upper alignment section 96 is, in fact, generally conical. The lower section 92 of the connector 90 is positioned within the interior of base 70. The upper section 96 projects above the upper edge 75 of the base as best seen in FIG. 2C. The connector is welded in place by peripheral weld or tack weld 96. The lower end of column 80 is then positioned over the upper portion 96 of the connector. The tapered alignment section 96 permits column 80 to be adjusted to the precise vertical position. When this is done, tack welds are placed at the lower edge of the column 80 securing column 80 to the connector body. The tack welds 96 and 98 can be completed by placing a continuous fillet weld 98 peripherally around the lower edge of the column and a fillet weld 97 around the upper edge of base 70 rigidly securing both to the column body. This completes the column structure as an integral structural unit ready for attachment of other members such as roof support beams or rafters.

FIGS. 4A to 4E and FIG. 5 show an alternate embodiment of the present invention which is generally designated by the numeral 100. In this embodiment, the base of the column is placed on a footing below the grade elevation of the floor or slab. This is sometimes necessary due to construction conditions such as the existence of conduits, pipes and other interfering structures in or below the floor slab. In this embodiment, the site 110 first is prepared. A footing 112 is placed at the location of the column as seen in FIG. 4A. Suitable anchor bolts 114 are embedded in the footing. Thereafter, sub-base 115 of ABC or other material is put in place leaving an open area 117 for the column. The column bearing plate 116 is secured to the anchor bolts 114 by suitable nuts 118. Double nuts 122 may be provided intermediate the base plate and the upper surface of the footing if necessary to level the base plate. Base member 120 is secured to the bearing plate by welding at 125.

Figure 4B:
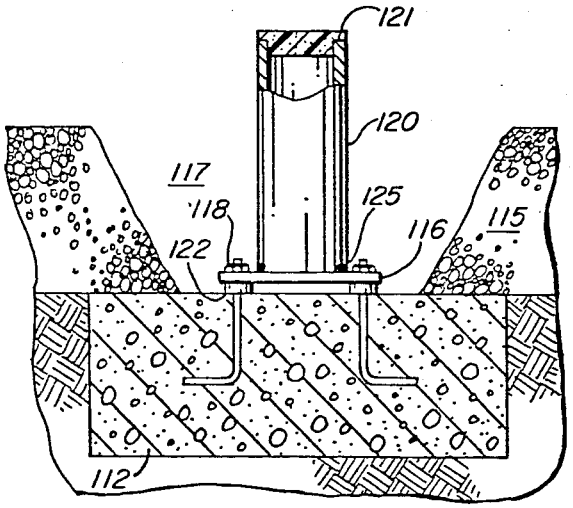
Figure 4C:
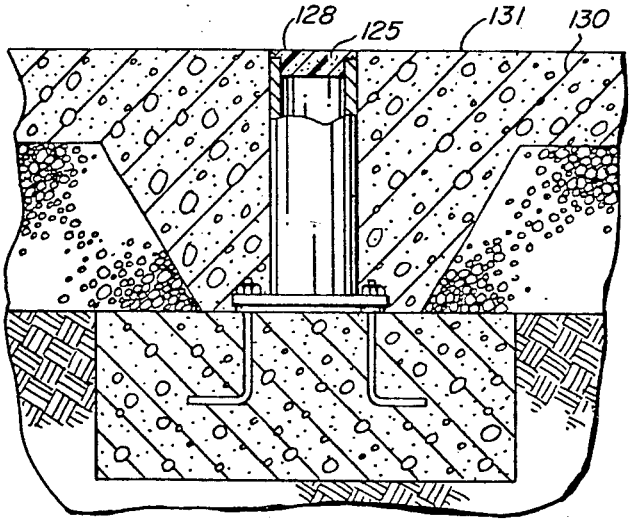

Base member 120 is shown as a generally tubular or cylindrical stub shaft which is welded at its periphery to the base plate 116. The overall length of the stub shaft 120 is selected so that the upper edge 121 of the shaft 120 is selected so that the upper edge 121 of the shaft 120 terminates at an elevation slightly below the plane of the upper surface of the finished floor. Typically, approximately one-quarter inch clearance is sufficient. A removable plug 125 is placed in the upper, open end of the base stub 120. The plug may be wooden, foam, plastic or similar inexpensive material. As shown in FIG. 4C, the plug may have an annular notch 127 extending about its periphery to tightly engage the inner diameter of the shaft 120. Floor 130 is now poured and the upper surface 128 of the plug 126. The remainder of the column base is supported on the foundation footing at the base plate 116 and embedded in the floor slab as seen in FIG. 4C.

Figure 5:
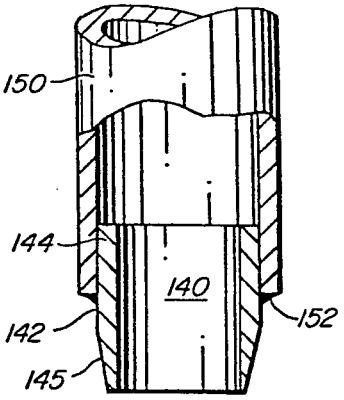
FIG. 5 is a sectional view taken along lines 5—5 of FIG. 4D.
Figure 4D:
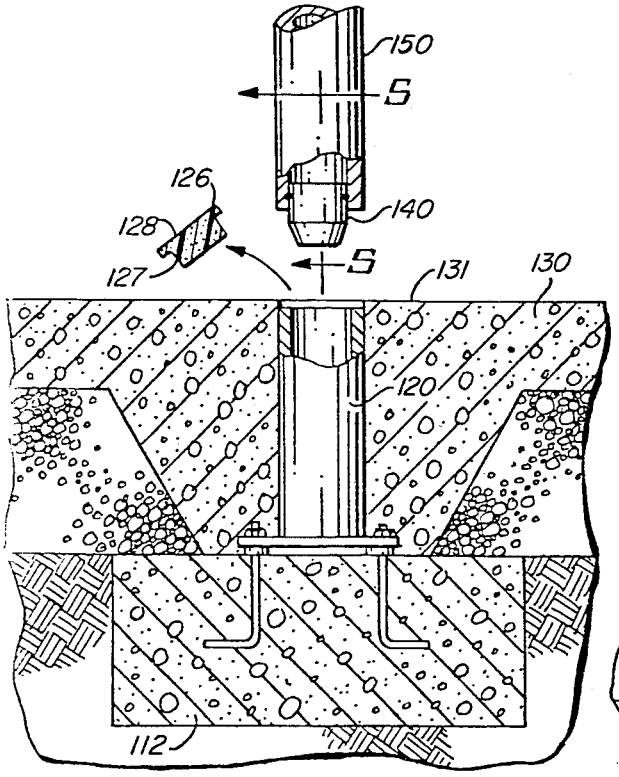
Figure 4E:
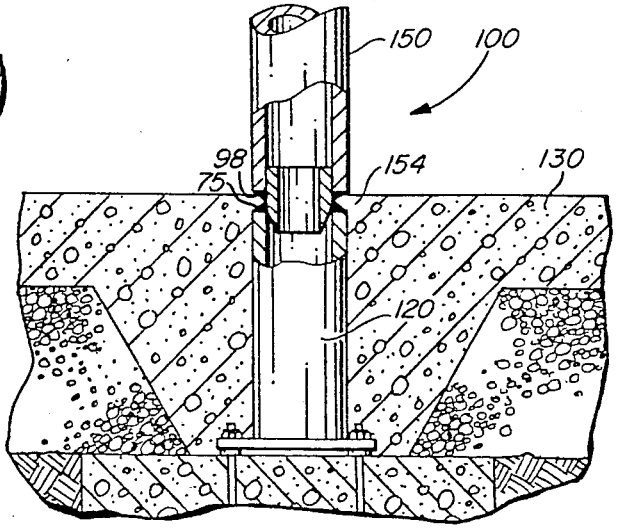

When the floor has set-up, the plug 126 is removed or broken away as shown in FIG. 4D. The column base is now ready to accept the connector 140 and the generally tubular or cylindrical column 150. As seen in FIG. 5, the connector 140 has a body 142 having a generally cylindrical upper portion 144 and an alignment section which consists of a conical shaped section 145 projecting downwardly. The upper body section 144 is tightly received within the lower end of tubular column member 150 and welded in place at 152. The assembly of the column 150 and connector 140 is then positioned in the upper end of the stub shaft 120 and the column precisely aligned to the desired vertical position as seen in FIG. 4E. The body of connector 140 is then tack welded to the upper edge of the stub shaft. The clearance space below the elevation of floor slab 131 and the upper end of the column base provides an area for the placement of the tack welds. When the tack welding is completed, a continuous fillet weld 154 is placed about both the lower edge of the column and the upper edge of the base securing both to the connector to form a rigid, integral structure.

From the foregoing, it will be apparent that the described system for column erection provides many advantages foremost of which is the ability to rapidly assemble the columns with minimum labor and at a minimum time. The components are relatively simple and readily available. Cutting away or breaking of concrete is not required in the erection method. Further, since the system has a connector with alignment means, precise positioning of the columns is achieved. It is estimated that the cost savings with the present invention will result in as much as sixty percent over presently utilized conventional method.

One particular advantage is that the system allows the contractor to erect a beam with supporting columns attached as a unit. A beam, steel or laminated, is fitted with columns at the appropriate locations with bolts on fasteners which are only loosely secured. The columns are provided with the coupling or connector of the invention. The entire assembly consisting of the beam and multiple columns may then be tilted or hoisted into position, aligned and secured in place, greatly reducing the tie, labot and cost of erection.

To those skilled in the art to which this invention pertains, various applications and embodiments will suggest themselves. To the extent that these various changes and alterations do not depart from the spirit and scope of the appended claims, they are intended to be encompassed therein. For example, the invention has been described with reference to generally cylindrical or tubular column members. It will be obvious that a connector with alignment means having other various geometric shapes can also be utilized. Likewise, aluminum or other materials of equivalent strength might be used in place of the structural steel components described. Accordingly, the disclosure herein is intended to be purely illustrative and not limiting except as defined by the appended claims.

I claim:

1. A building column structure to be supported on a footing, said structure comprising:

(a) a base on said footing having an upwardly extending tubular support member defining a first connection surface;

(b) a rigid vertical column support member having a lower section defining a generally circular second connection surface;

(c) rigid coupling connector means having third and fourth generally circular connection surfaces, respectively cooperable with said first and second connection surfaces;

(d) one of said third and fourth connection surfaces comprising a smoothly inwardly tapering conical section whereby said vertical column support member can be vertically adjusted and aligned with respect to said tubular support member at said conical section; and (e) a weldment securing said base, column and coupling connector means as a rigid unit.

* * * * *